US008925653B2

(12) United States Patent
Dotson et al.

(10) Patent No.: US 8,925,653 B2
(45) Date of Patent: Jan. 6, 2015

(54) APPARATUS AND METHOD FOR HIGH PRESSURE ABRASIVE FLUID INJECTION

(75) Inventors: Thomas L. Dotson, Woodburn, KY (US); Henry Wohltjen, Bowling Green, KY (US)

(73) Assignee: TD Tools, Inc., Woodburn, KY (US)

( * ) Notice: Subject to any disclaimer, the term of this patent is extended or adjusted under 35 U.S.C. 154(b) by 776 days.

(21) Appl. No.: 12/932,558

(22) Filed: Feb. 28, 2011

(65) Prior Publication Data

US 2012/0217011 A1 Aug. 30, 2012

(51) Int. Cl.
*E21B 21/01* (2006.01)
*E21B 43/114* (2006.01)

(52) U.S. Cl.
CPC ..... *E21B 43/114* (2013.01)
USPC ..... 175/65; 175/424; 166/222; 166/75.15

(58) Field of Classification Search
CPC ..... E21B 7/16; E21B 7/18
USPC ..... 175/65, 424; 166/305.1, 222, 75.15, 166/75.12
See application file for complete search history.

(56) References Cited

U.S. PATENT DOCUMENTS

| | | | | |
|---|---|---|---|---|
| 3,713,499 | A * | 1/1973 | Arscott et al. | 175/66 |
| 4,534,427 | A * | 8/1985 | Wang et al. | 175/67 |
| 4,621,655 | A * | 11/1986 | Roche | 137/81.2 |
| 4,665,944 | A * | 5/1987 | Wallace et al. | 137/580 |
| 5,006,044 | A * | 4/1991 | Walker et al. | 417/12 |
| 5,063,775 | A * | 11/1991 | Walker et al. | 73/152.31 |
| 5,857,530 | A * | 1/1999 | Gronseth | 175/45 |
| 6,386,300 | B1 * | 5/2002 | Curlett et al. | 175/65 |
| 6,454,010 | B1 * | 9/2002 | Thomas et al. | 166/369 |
| 6,581,700 | B2 * | 6/2003 | Curlett et al. | 175/65 |
| 7,159,660 | B2 | 1/2007 | Justus | |
| 7,343,987 | B2 * | 3/2008 | Tibbitts | 175/67 |
| 7,383,896 | B2 * | 6/2008 | Tibbitts | 175/66 |
| 7,398,838 | B2 * | 7/2008 | Harder et al. | 175/54 |
| 7,398,839 | B2 * | 7/2008 | Harder et al. | 175/67 |
| 7,503,407 | B2 * | 3/2009 | Tibbitts | 175/67 |
| 7,527,092 | B2 * | 5/2009 | McAfee | 166/55.7 |
| 7,546,876 | B2 * | 6/2009 | McAfee | 166/298 |
| 8,047,285 | B1 * | 11/2011 | Smith | 166/260 |
| 2002/0100615 | A1 * | 8/2002 | Curlett et al. | 175/65 |
| 2003/0044299 | A1 * | 3/2003 | Thomas et al. | 418/206.9 |
| 2005/0230152 | A1 * | 10/2005 | Joslin | 175/67 |
| 2006/0011386 | A1 * | 1/2006 | Tibbitts | 175/67 |
| 2006/0016622 | A1 * | 1/2006 | Tibbitts | 175/38 |
| 2006/0016624 | A1 * | 1/2006 | Tibbitts | 175/67 |
| 2006/0021798 | A1 * | 2/2006 | Tibbitts | 175/67 |

(Continued)

OTHER PUBLICATIONS

Cobbett, J.S., "Sand jet perforating revisited", SPE 55044, SPE Drill & Completion, vol. 14, No. 1, p. 28-33, Mar. 1999.

(Continued)

*Primary Examiner* — Jennifer H Gay
*Assistant Examiner* — Elizabeth Gitlin
(74) *Attorney, Agent, or Firm* — Fulbright & Jaworski LLP

(57) ABSTRACT

A method and system are provided for injecting high pressure abrasive fluid into an abrasive jet tool. The method and system comprise a slurry tank connected to an abrasive hopper and a low pressure abrasive pump for circulating abrasive slurry and transferring the slurry to a high pressure vessel. The method and system also contain a high pressure non-abrasive pump connected to a high pressure valve for pressurizing the high pressure vessel prior to injecting abrasive fluid into the abrasive jet tool.

12 Claims, 7 Drawing Sheets

(56) References Cited

U.S. PATENT DOCUMENTS

| | | | | |
|---|---|---|---|---|
| 2006/0180350 | A1* | 8/2006 | Harder et al. | 175/54 |
| 2006/0191717 | A1* | 8/2006 | Harder et al. | 175/54 |
| 2006/0191718 | A1* | 8/2006 | Harder et al. | 175/54 |
| 2007/0175636 | A1* | 8/2007 | McAfee | 166/297 |
| 2008/0210472 | A1* | 9/2008 | Tibbitts | 175/54 |
| 2008/0230275 | A1* | 9/2008 | Harder et al. | 175/57 |
| 2008/0277118 | A1* | 11/2008 | McAfee | 166/298 |
| 2009/0200080 | A1* | 8/2009 | Tibbitts et al. | 175/54 |
| 2009/0223718 | A1* | 9/2009 | Tibbitts | 175/67 |
| 2010/0307830 | A1* | 12/2010 | Curlett | 175/61 |
| 2012/0118562 | A1* | 5/2012 | Mcafee et al. | 166/222 |

OTHER PUBLICATIONS

Li, Gensheng et al., "Abrasive water jet perforation—An alternative approach to enhance oil production", Petroleum Science and Technology, vol. 22, No. 5&6, p. 491-504, 2004.

* cited by examiner

APPARATUS AND METHOD FOR HIGH PRESSURE ABRASIVE FLUID INJECTION

BACKGROUND OF THE INVENTION

1. Field of the Invention

This invention relates generally to the field of treating wells to stimulate fluid production. More particularly, the invention relates to the field of high pressure abrasive fluid injection in oil and gas wells.

2. Description of the Related Art

Abrasive jet perforating uses fluid slurry pumped under high pressure to perforate tubular goods around a wellbore, where the tubular goods include tubing, casing, and cement. Since sand is the most common abrasive used, this technique is also known as sand jet perforating (SJP). Abrasive jet perforating was originally used to extend a cavity into the surrounding reservoir to stimulate fluid production. It was soon discovered, however, that abrasive jet perforating could not only perforate, but cut (completely sever) the tubular goods into two pieces. Sand laden fluids were first used to cut well casing in 1939. Abrasive jet perforating was eventually attempted on a commercial scale in the 1960s. While abrasive jet perforating was a technical success (over 5,000 wells were treated), it was not an economic success. The tool life in abrasive jet perforating was measured in only minutes and fluid pressures high enough to cut casing were difficult to maintain with pumps available at the time. A competing technology, explosive shape charge perforators, emerged at this time and offered less expensive perforating options.

Consequently, very little work was performed with abrasive jet perforating technology until the late 1990's. Then, more abrasive-resistant materials used in the construction of the perforating tools and jet orifices provided longer tool life, measured in hours or days instead of minutes. Also, advancements in pump materials and technology enabled pumps to handle the abrasive fluids under high pressures for longer periods of time. The combination of these advances made the abrasive jet perforating process more cost effective. Additionally, the recent use of coiled tubing to convey the abrasive jet perforating tool down a wellbore has led to reduced run time at greater depth. Further, abrasive jet perforating did not require explosives and thus avoids the accompanying danger involved in the storage, transport, and use of explosives. However, the basic design of abrasive jet perforating tools used today has not changed significantly from those used in the 1960's.

Abrasive jet perforating tools and casing cutters were initially designed and built in the 1960's. There were many variables involved in the design of these tools. Some tool designs varied the number of jet locations on the tool body, from as few as two jets to as many as 12 jets. The tool designs also varied the placement of those jets, such, for example, positioning two opposing jets spaced 180° apart on the same horizontal plane, three jets spaced 120° apart on the same horizontal plane, or three jets offset vertically by 30°. Other tool designs manipulated the jet by orienting it at an angle other than perpendicular to the casing or by allowing the jet to move toward the casing when fluid pressure was applied to the tool.

The following publications are representative of conventional abrasive jet perforating and cutting tools, along with apparatuses and methods that may be employed with the tools.

An SPE publication by J. S. Cobbett, "Sand Jet Perforating Revisited", SPE 55044, SPE Drill. & Completion, Vol. 14, No. 1, p. 28-33, March 1999, discloses the use of sand jet perforating (abrasive jet perforating) with coiled tubing to increase production in damaged wells, using examples of neglected wells in Lithuania.

A publication by Gensheng Li et al., "Abrasive Water Jet Perforation—An Alternative Approach to Enhance Oil Production", *Petroleum Science and Technology*, Vol. 22, Nos. 5 & 6, p. 491-504, 2004, discloses laboratory results and field tests showing the effects of different parameters on the ability of abrasive water jet perforating (abrasive jet perforating) to improve well performance and the mechanism by which it works.

A new way to incorporate abrasive fluid or slurry into a high pressure fluid stream has been needed for many years. However, recent demands for certain oilfield technology have increased that need. Currently, large fracturing pumps or cementing pumps are used to pump the abrasive fluid to sand jet perforating tools. A polymer or gel is added to the carrier fluid (usually water) and then the abrasive is either mixed in batch or added "on the fly" through a mechanical feeder into the fluid stream at high volume, but low pressure. The low pressure allows techniques like Venturi mixers (such as mud mixers or water jet eductors) to be used to incorporate the abrasive into the fluid. These low pressure techniques do not work for mixing at the high pressures produced by pumps that operate from 2,000 psi to 10,000 psi, since the pressure differential is too great. After the slurry is mixed at low pressure, it is then fed to the abrasive high pressure pump unit. These pumps have valves, plungers and other parts that are made of materials able to withstand the eroding action of the abrasive fluid at high pressure. The fluid slurry is then pumped at high pressure downhole to the abrasive jet tool.

Other industries (such as high pressure water blasting) that use abrasives on the surface with high pressure for cleaning and cutting, currently add the abrasive in front of the fluid stream. This process keeps the abrasive from contact with the high pressure equipment. However, the abrasive is not as effective when added to the high pressure fluid stream at the end as when the sand is already entrained in the fluid. The sand particles do not have time to reach full velocity before they encounter the target material.

Thus, a need exists for a system and a method for more efficiently and more inexpensively injecting an abrasive fluid mixture into a high pressure fluid flow for use in an abrasive jet tool.

BRIEF SUMMARY OF THE INVENTION

The invention is a system and a method for injecting high pressure abrasive fluid into an abrasive jet tool in a wellbore. In one embodiment, the invention is a system for injecting high pressure abrasive fluid into an abrasive jet tool in a wellbore, comprising an abrasives hopper; a slurry tank connected to the abrasives hopper; a low pressure abrasive pump connected to the slurry tank; a first high pressure vessel connected to the low pressure pump through a first high pressure valve; a high pressure non-abrasive pump connected to the first high pressure vessel through a second high pressure valve; and an abrasive jet tool connected to the first high pressure vessel through a third high pressure valve.

In another embodiment, the invention is a method for injecting high pressure abrasive fluid into an abrasive jet tool in a wellbore. Low pressure abrasive slurry is mixed by circulating the abrasive slurry from a slurry tank, through a low pressure abrasive pump, by an abrasive hopper, and back to the slurry tank. The low pressure abrasive slurry is circulated from the slurry tank, through the low pressure abrasive pump, through a second high pressure valve, through a first high pressure vessel, through a third high pressure valve, and back to the slurry tank. High pressure non-abrasive fluid is sent by a high pressure non-abrasive pump through a first high pressure valve to a first high pressure vessel. The second high pressure valve is opened to allow abrasive slurry to fill the first high pressure vessel. The first, second, and third high pressure valves are rotated to allow the high pressure non-abrasive fluid to push the abrasive slurry through the first high pressure vessel to an abrasive jet tool.

BRIEF DESCRIPTION OF THE DRAWINGS

The invention and its advantages may be more easily understood by reference to the following detailed description and the attached drawings, in which.

While the invention will be described in connection with its preferred embodiments, it will be understood that the invention is not limited to these. On the contrary, the invention is intended to cover all alternatives, modifications, and equivalents that may be included within the scope of the invention, as defined by the appended claims.

DETAILED DESCRIPTION OF THE INVENTION

The invention is a system and a method for injecting an abrasive fluid mixture into a high pressure fluid flow for use in an abrasive jet tool. In one primary embodiment, the invention is an apparatus and a method for providing an abrasive fluid mixture for abrasive jet perforating or cutting tools in wells. In other embodiments, however, the invention could be used in other oilfield related work that requires high pressure fluids that contain abrasive material (such as fracturing or cementing). In yet other embodiments, the invention could also be employed in the high pressure cleaning industry and in numerous other industrial applications. By inserting the abrasive material downstream of the high pressure pump, the invention allows the use of a much more common and less expensive fresh water pump instead of a specialized pump that can withstand abrasives (such as a hydraulic fracturing pump or an oilfield cementing pump). The system is portable and can be mounted on a skid or trailer with a pump unit, if desired.

Figure 1:
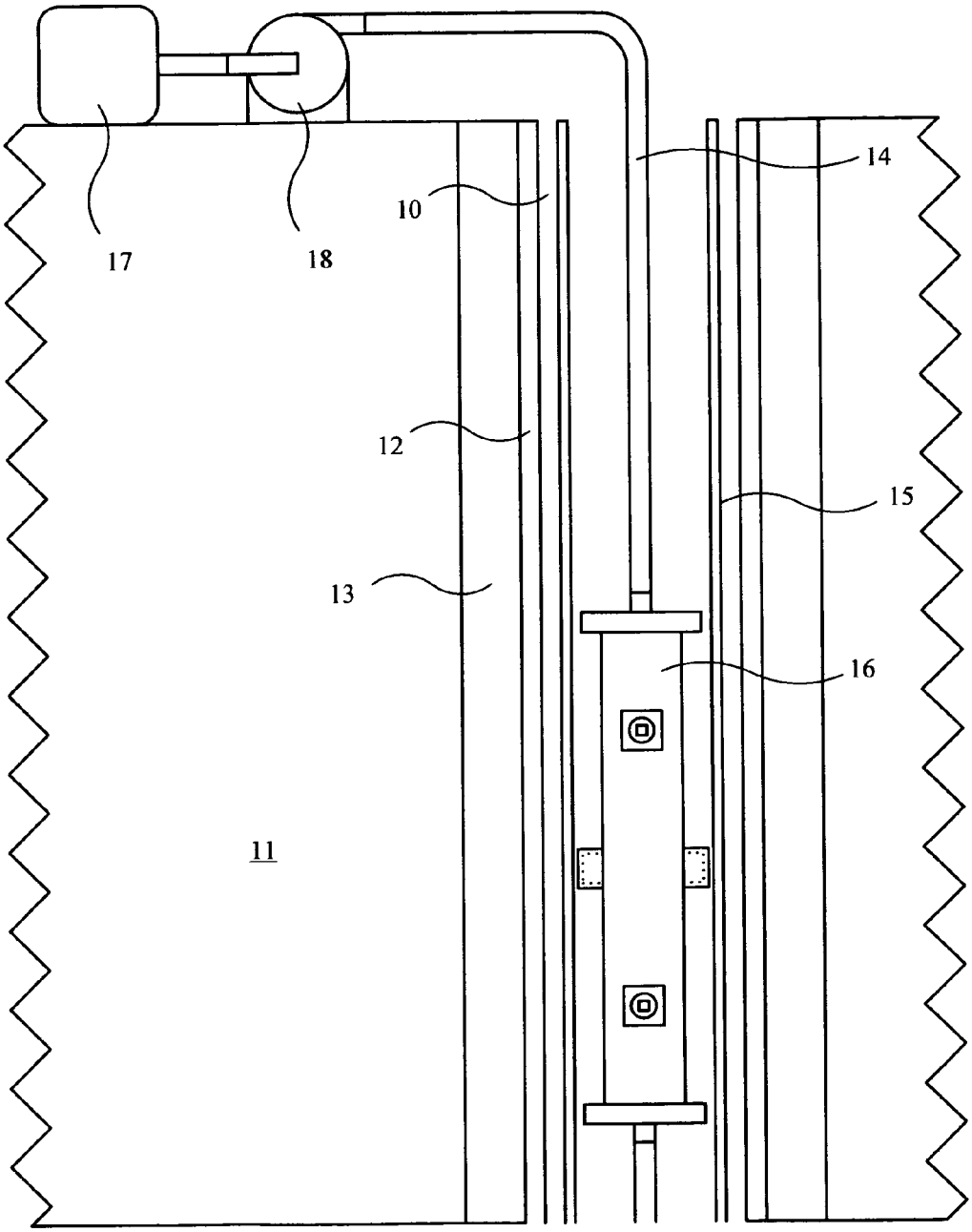
FIG. 1 shows a schematic side view of an abrasive jet tool in a wellbore.

FIG. 1 shows a schematic side view (not necessarily to scale) of an abrasive jet tool in a wellbore. FIG. 1 shows a bottomhole assembly for cutting tubular members in a wellbore using an abrasive jet perforating tool, such as may be used in the present invention. A wellbore 10 is shown penetrating a reservoir 11. The wellbore 10 is surrounded by a casing 12 (or liner), which in turn is surrounded by cement 13, fixing the casing 12 to the reservoir 11. Tubing 14 extends vertically downward into the wellbore 10. The tubing 14 comprises jointed pipe, coiled tubing, or any other type of tubing used in a well. Suspended from the tubing 14 inside a tubular member 15 is an abrasive jet tool 16. Surface equipment, such as mixing tank 17 and pump 18, provide a slurry of abrasive-containing fluid to the abrasive jet tool 16 by means of the tubing 14.

The abrasive jet tool 16 includes, but is not limited to, an abrasive jet perforating tool, abrasive jet cutting tool, abrasive jet cleaning tool, abrasive jet fracturing tool, abrasive jet cementing tool, or abrasive jet tool performing multiple functions. For example, use of the abrasive jet tool 16 as an abrasive jet perforating tool is described in co-pending U.S. patent application Ser. No. 12/380,062, "Apparatus and Method for Abrasive Jet Perforating", filed Feb. 22, 2009, with the inventor of the present application as co-inventor. Use of the abrasive jet tool 16 as an abrasive jet cutting tool is described in co-pending U.S. patent application Ser. No. 12/653,803, "Apparatus and Method for Abrasive Jet Perforating and Cutting of Tubular Members", filed Dec. 18, 2009, with the inventor of the present application as inventor.

Figure 4:
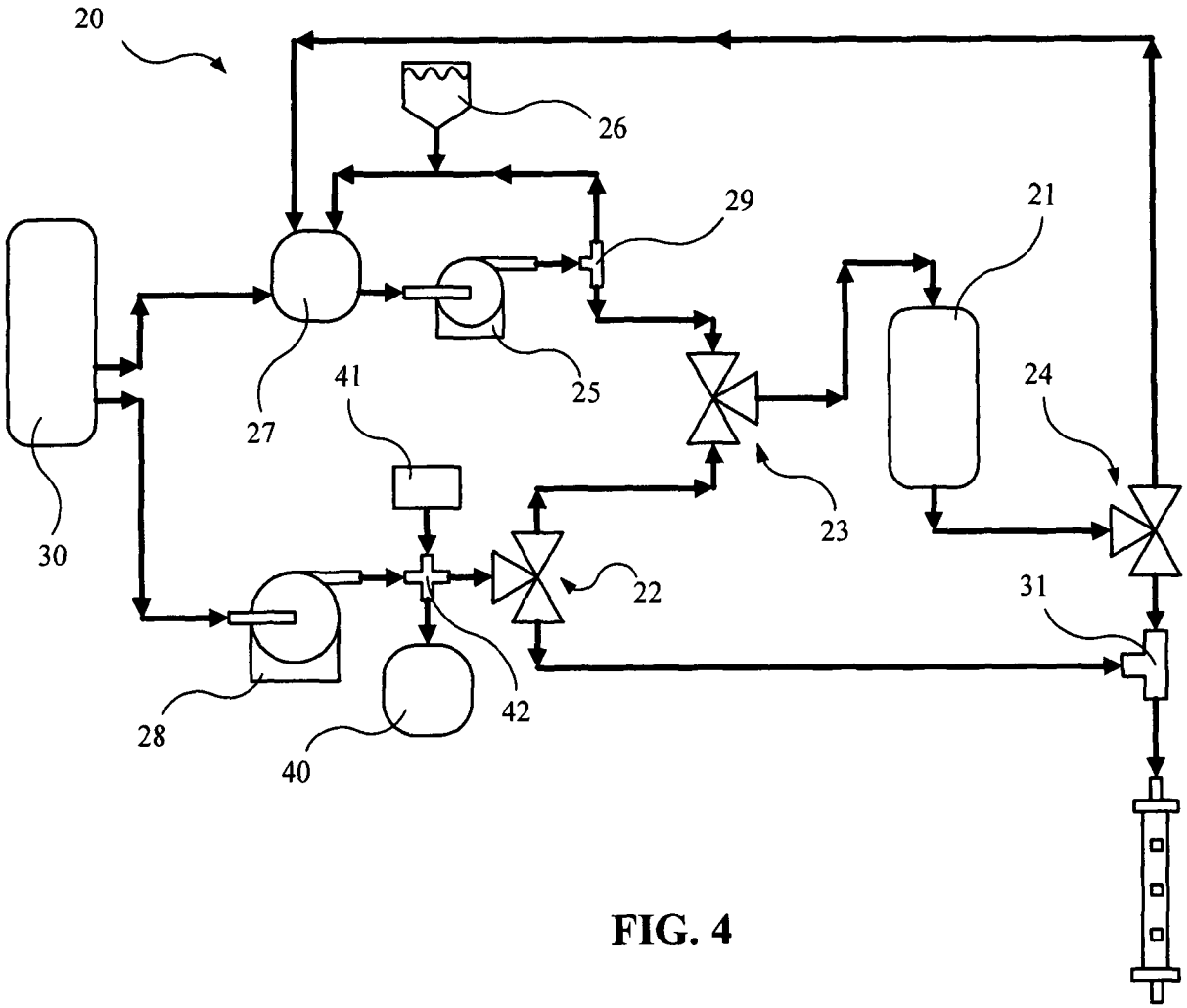
FIG. 4 shows a schematic view of the system of the invention for high pressure abrasive fluid injection, similar to FIG. 2, illustrating further embodiments.
Figure 5:
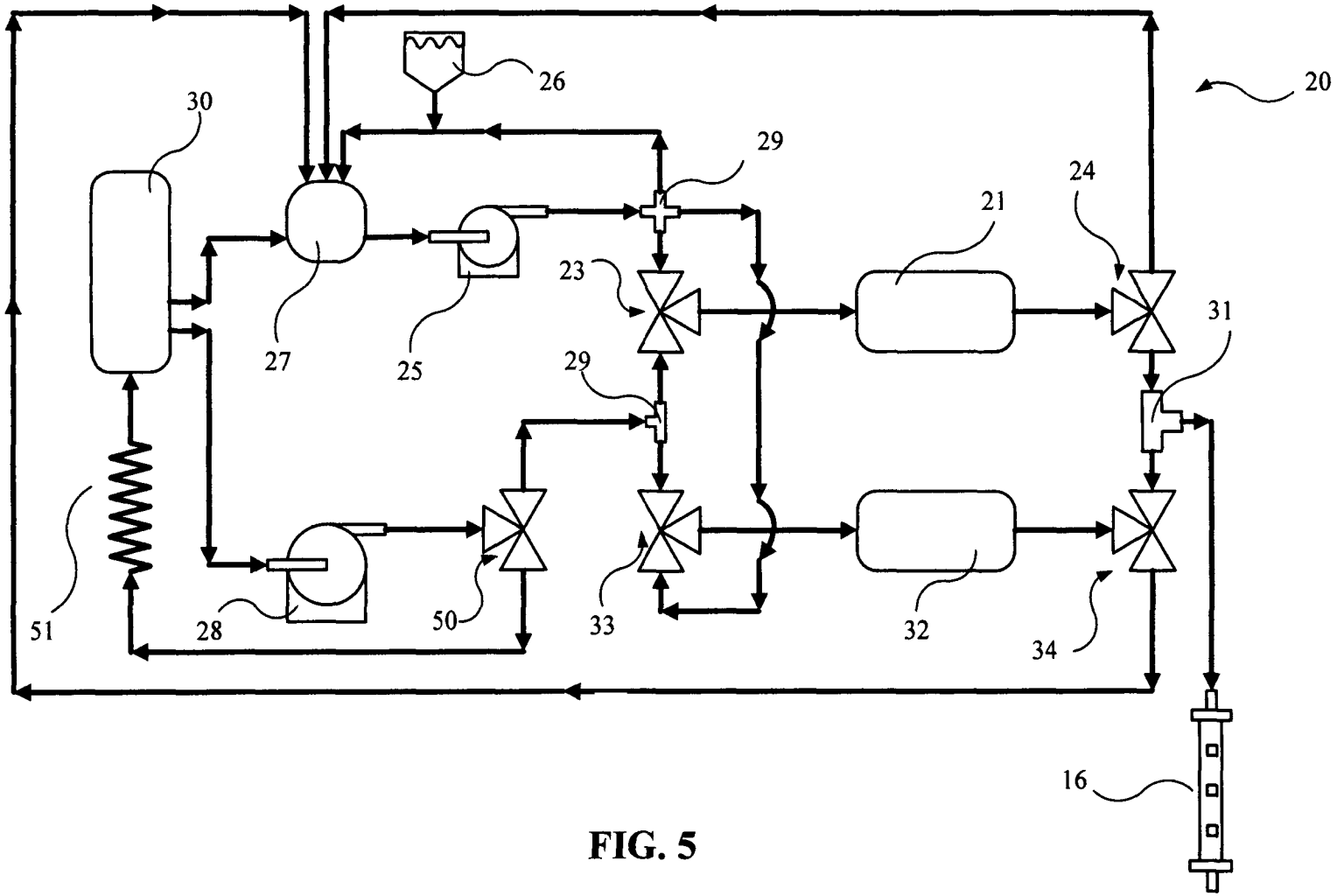
FIG. 5 shows a schematic view of the system of the invention for high pressure abrasive fluid injection, similar to FIG. 3, illustrating further embodiments.
Figure 6:
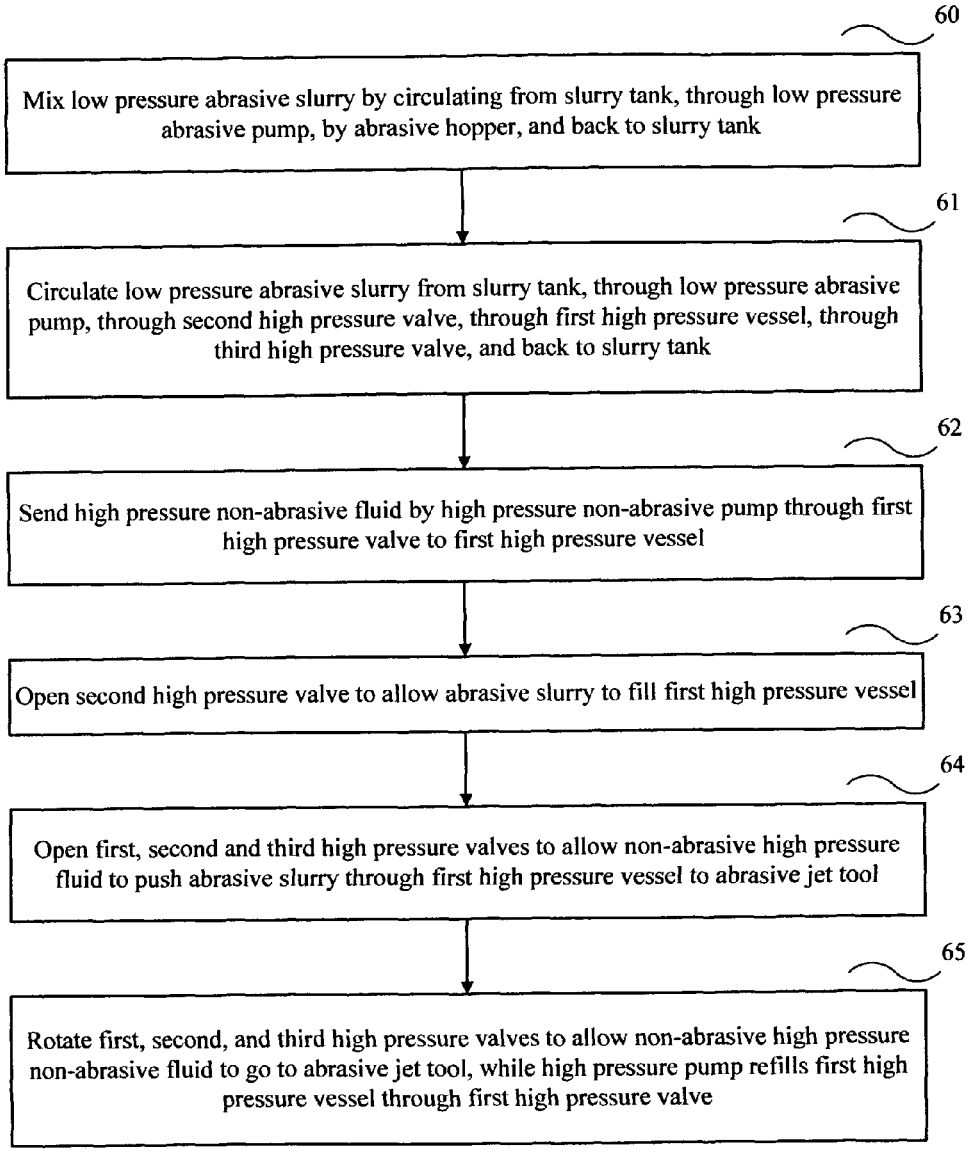
FIG. 6 shows a flowchart illustrating an embodiment of the method of the invention for high pressure abrasive fluid injection, using the system in FIG. 2.
Figure 7:
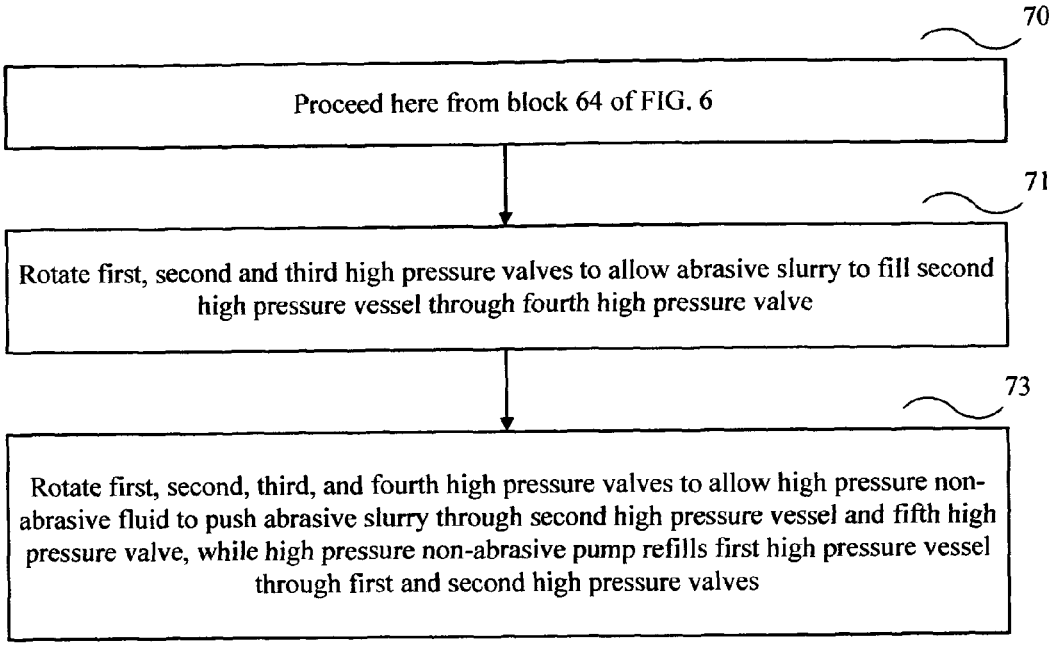
FIG. 7 shows a flowchart illustrating an embodiment of the method of the invention for high pressure abrasive fluid injection, using the system in FIG. 3.

FIGS. 2-5 show schematic views of different embodiments of the system of the invention for high pressure abrasive fluid injection. FIGS. 6 and 7 show flowcharts illustrating embodiments of the method of the invention corresponding to the embodiments of the system illustrated in FIGS. 2 and 3, respectively.

Figure 2:
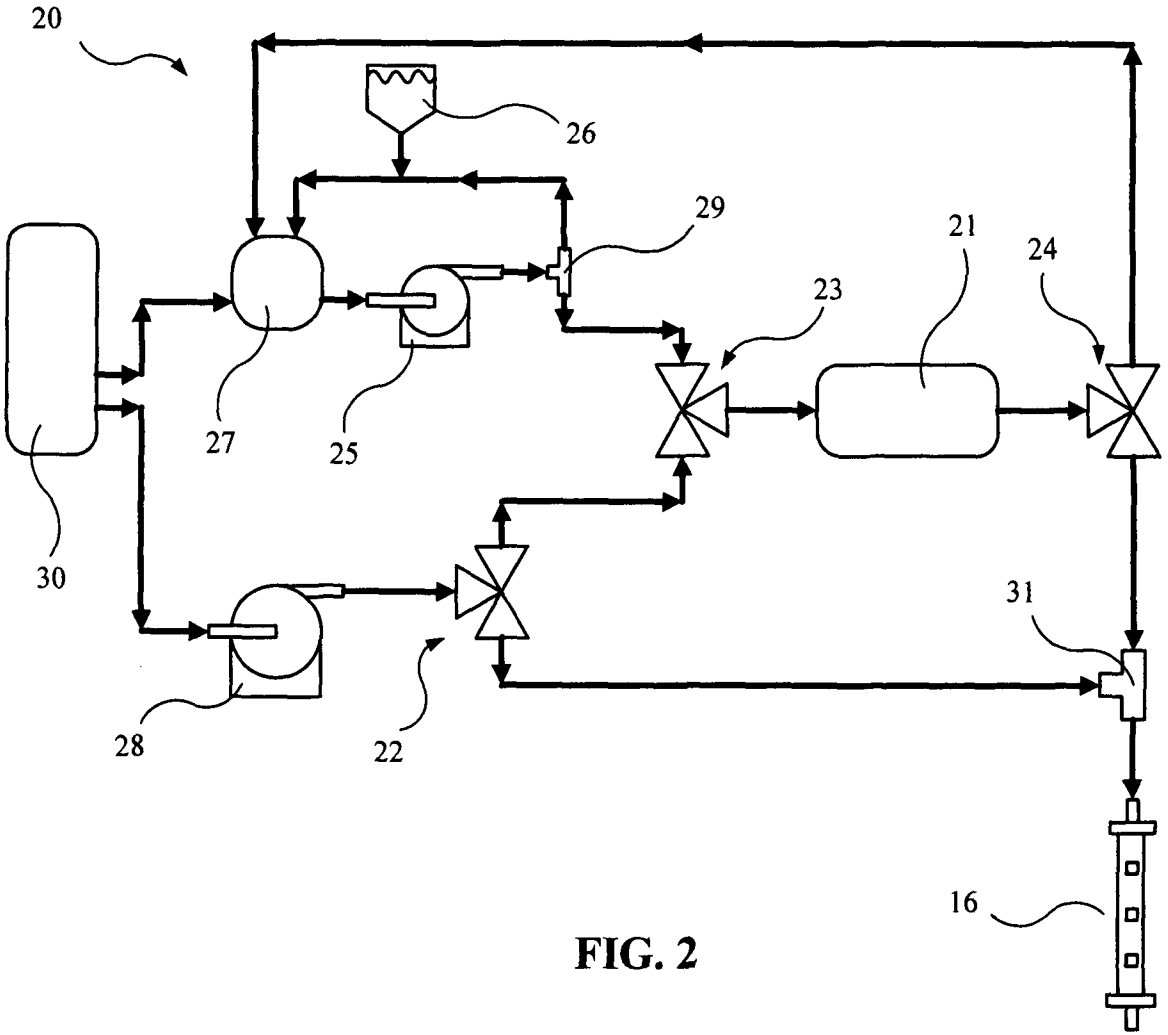
FIG. 2 shows a schematic view of one embodiment of the system of the invention for high pressure abrasive fluid injection.

FIG. 2 shows a schematic view (not necessarily to scale) of one embodiment of the system of the invention for high pressure abrasive fluid injection. In this embodiment, the abrasive jet tool 16 has high pressure abrasive fluid provided to it by the system of the invention and according to an embodiment of the method of the invention, described below with regard to the flowchart in FIG. 6.

The system of the invention illustrated in FIG. 2 is designated generally by the reference numeral 20. In its simplest form, this embodiment of the system 20 of the invention comprises a first high pressure vessel 21, a first high pressure valve 22, a second high pressure valve 23, a third high pressure valve 24, a low pressure abrasive pump 25, an abrasive hopper 26, a slurry tank 27 and a high pressure non-abrasive pump 28.

The first high pressure vessel 21 is used as delivery tank to provide abrasive fluid at high pressure to the abrasive jet tool 16. The high pressure valves 22, 23, 24 are remotely activated and are configured as three-way valves. The high pressure valves 22, 23, 24 could be controlled by computer to automatically adjust the timing and sequence of opening and closing of the high pressure valves 22, 23, 24 based on fluid flow and desired abrasive concentration. The low pressure abrasive pump 25 is used as a circulating pump, to provide the abrasive slurry, while the high pressure pump 28 is used to provide the high pressure fluid. The abrasive hopper 26 supplies the abrasives (typically sand) to be mixed with fluid in the slurry tank 27 and is also known as a mud hopper or a mud mixer.

The first high pressure valve 22 is connected to the output side of the high pressure pump 28, while the second and third high pressure valves 23, 24 are connected to the input and output sides, respectively, of the first high pressure vessel 21. The left hand valves of the three-way valves in the first high pressure valve 22 and the third high pressure valve 24 are common valves, while the right-hand valve on the second high pressure valve 23 is also a common valve. The upper valve in the three-way valves in the second high pressure valve 23 and the third high pressure valve 24 are normally closed valves, while the lower valve on the first high pressure valve 22 is also a normally closed valve. Conversely, the lower valve in the three-way valves in the second high pressure valve 23 and the third high pressure valve 24 are normally open valves, while the upper valve on the first high pressure valve 22 is also a normally open valve.

Low pressure abrasive slurry is created and continually mixed as it circulates from the slurry tank 27, through the low pressure abrasive pump 25, through a low pressure tee 29, then the abrasive hopper 26, and back to the slurry tank 27. The liquid, typically water, for the abrasive slurry is supplied by a water supply tank 30. The low pressure abrasive slurry is also circulated from the slurry tank 27, through the low pressure abrasive pump 25, through the low pressure tee 29, through the second high pressure valve 23, into and through the first high pressure vessel 21, through the third high pressure valve 24, and back to the slurry tank 27.

The high pressure non-abrasive pump 28 sends high pressure non-abrasive fluid, typically water, from the water supply tank 30, through the first high pressure valve 22, and into the first high pressure vessel 21. When high pressure abrasive fluid is desired, the lower valve in the second high pressure valve 23 opened to allow abrasive slurry to fill the high pressure vessel 21. Once the first high pressure vessel 21 is full of high pressure slurry, the appropriate valves in the first, second, and third high pressure valves 22, 23, 24 can be rotated to allow the high pressure fluid to push the abrasive slurry through the first high pressure vessel. 21, through a high pressure tee 31, and on to the abrasive jet tool 16.

After the abrasive-carrying fluid has exited the first high pressure vessel 21, the high pressure valves 22, 23, 24 can be rotated to allow more non abrasive fluid to go directly to the abrasive jet tool 16 while the first high pressure vessel 21 is refilled from the high pressure pump 28 by way of the first high pressure valve 22 and the high pressure tee 31. In this manner, the abrasive slurry is injected into the pressurized tubing system, alternating with "slugs" of non abrasive fluid.

Parts of the system 20 will come in contact with the high pressure injected abrasive fluid, including the interior parts of the first high pressure vessel 21, of the high pressure valves 22, 23, 24, and of the high pressure tee 31. These parts of the system 20 that comes into contact with the high pressure injected abrasive fluid are thus preferably composed of materials that are highly resistant to abrasion. These materials include, but are not restricted to, tungsten carbide, boron carbide, alumina, cubic zirconium (or other appropriate ceramics), and steel alloy with a protective coating. These abrasive-resistant materials are more expensive than conventional oilfield equipment materials, but can be used to increase wear life in the valves and other equipment subject to abrasive fluid flow.

An advantage of the invention is that, unlike conventional methods of high pressure abrasive fluid injection, parts of the system 20 will no longer have to come in contact with the high pressure injected abrasive fluid. In particular, these parts now include the interior parts of the low pressure pump 25.

Depending on the specific application desired, the preferred embodiment may use one or more variations to this basic configuration. A first alternative embodiment, with multiple high pressure vessels, is illustrated here in FIG. 3. Further alternative embodiments are illustrated in FIGS. 4 and 5, below.

Figure 3:
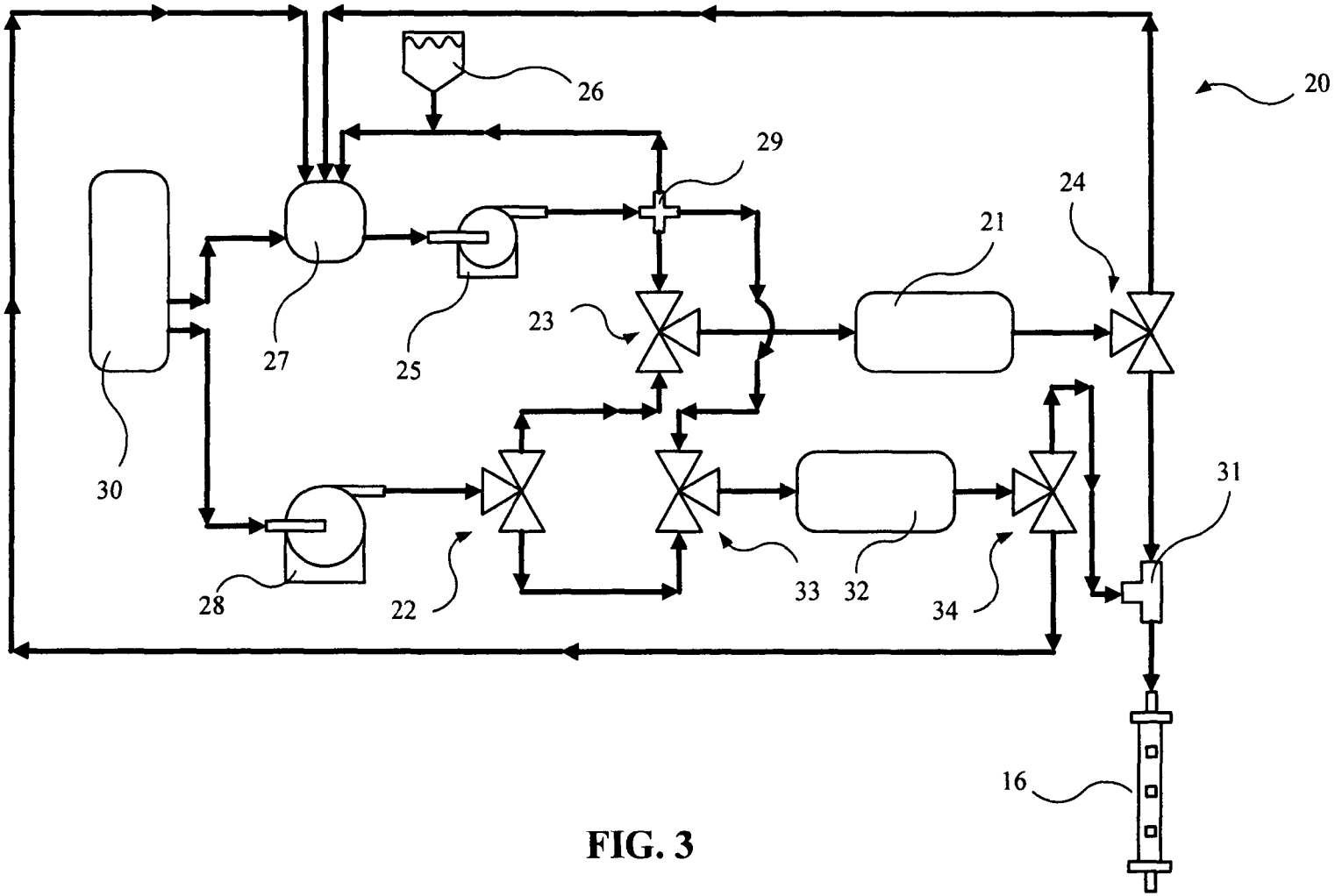
FIG. 3 shows a schematic view of another embodiment of the system of the invention for high pressure abrasive fluid injection, using multiple high pressure vessels.

FIG. 3 shows a schematic view (not necessarily to scale) of another embodiment of the system of the invention for high pressure abrasive fluid injection, using multiple high pressure vessels. In this preferred embodiment, the abrasive jet tool 16 has high pressure abrasive fluid provided to it by the system of the invention and according to the method of the invention, described below with regard to the flowchart in FIG. 6.

The embodiment of the system 20 of the invention illustrated in FIG. 3 is similar to the embodiment of the system 20 illustrated in FIG. 2, above. The difference is the addition of a second high pressure vessel 32, a fourth high pressure valve 33, and a fifth high pressure vale 34. The fourth and fifth high pressure valves 33, 34 are connected to the input and output sides, respectively, of the second high pressure vessel 32. The system 20 of the invention could have any number of high pressure vessels and accompanying pairs of connected high pressure valves. The system 20 is illustrated here with only two vessels and pairs of valves for simplicity of illustration, and is not intended to be a limitation of the invention.

The right hand valve in the fourth high pressure valve 33 and the left hand valve in the fifth high pressure valve 33 are common valves. The upper valve in the fourth high pressure valve 33 and the lower valve on the fifth high pressure valve 34 are normally closed valves. Conversely, the lower valve in the fourth high pressure valve 33 and the upper valve on the fifth high pressure valve 34 are normally open valves.

Having multiple high pressure vessels 21, 32 enables filling one high pressure vessel with slurry, while the other high pressure vessel is being pressurized and delivering slurry to the abrasive jet tool 16. The use of multiple high pressure vessels eliminates the need to cycle non abrasive fluid and abrasive fluid in the system 20.

FIG. 4 shows a schematic view (not necessarily to scale) of the system of the invention for high pressure abrasive fluid injection, illustrating further embodiments. The embodiment of the system 20 of the invention illustrated in FIG. 4 is similar to the embodiment of the system 20 illustrated in FIG. 2, above.

The first major difference in FIG. 4 is that the high pressure vessel 21 is specifically oriented vertically so that the abrasive, typically sand, in the slurry would tend to fall downward to the output side of the high pressure vessel 21. This vessel orientation would lessen the likelihood of the high pressure flow in the high pressure vessel 21 bypassing some of the slurry mixture. The shape of the high pressure vessel 21 could also affect its performance and the shape could be changed to maximize performance.

The second major difference in FIG. 4 is the addition of a pressure pulse damper 40 and a pressure sensor 41 connected through a high pressure cross tee 42 in the line going from the high pressure pump 28 to the first high pressure valve 22. The pressure pulse damper 40 is used to ease pressure spikes in the lines when the high pressure valves 22, 23, 24 open or close. The pressure sensor 41 sends a signal to the controller and is used to log the pressure during the operation.

Further alternative embodiments include the following. The line that returns fluid from the third high pressure valve 24 to the slurry tank 27 could also be disconnected to allow the fluid level in the slurry tank 27 to decrease. A float type valve (not shown) could be installed on the line connecting the water supply tank 30 to the slurry tank 27. Then, water would only be added to the slurry tank 27 as it is needed.

FIG. 5 shows a schematic view (not necessarily to scale) of the system of the invention for high pressure abrasive fluid injection, illustrating further embodiments. The embodiment of the system 20 of the invention illustrated in FIG. 5 is similar to the embodiment of the system 20 illustrated in FIG. 3, above, in utilizing multiple high pressure vessels.

However, FIG. 5 illustrates a slightly different configuration of valves, equipment, and connecting lines than in FIG. 3.

FIG. 5 illustrates that, in various embodiments, a variety of different valve and equipment configurations could be used in the system of the invention. Additionally, in various embodiments, the valves can also be actuated at different times or in a different sequence to achieve specific desired results. In these embodiments, a computer can be used to automatically adjust the timing and sequence based on flow and desired abrasive concentration.

In particular, in FIG. 5, the first high pressure valve 50 is now a "dump" valve. The dump valve 50 allows the other high pressure valves 23, 24, 33, 34 to operate under reduced pressure. The dump valve 50 diverts flow for 1-2 seconds at precisely the time for the high pressure valves 23, 24, 33, 34 to change position.

In addition, FIG. 5 illustrates the use of a flow restrictor 51 in the line running from the bottom of the dump valve 50 back to the water supply tank 30. The flow restrictor 51 helps to maintain pressure in the lines of the system 20 to expedite the opening of the high pressure valves 22, 23, 24, 33, 34.

In yet another embodiment, powdered guar is mixed with the sand in the abrasives hopper 26 to gel the fluid, instead of using liquid guar. The fluid is gelled in order to thicken the fluid enough to suspend and carry the sand in the fluid. Using liquid guar requires continual monitoring and addition of guar since the system 20 is continually adding fresh water from the water supply tank 30 as the high pressure vessel 21 empties. Mixing the powdered guar with the sand keeps the concentration of guar constant since the sand is being continually added through the abrasives hopper 26. This combination will be especially useful for abrasive fluid injection as the operator of the system 20 will only have to add the abrasive/guar mixture and not monitor the fluid viscosity.

One problem, however, can be clumping of the powdered guar in the hopper, thus preventing effective flow of the material through the hopper. The reason for the clumping was that occasionally the water would flow up into the hopper, partially hydrating the guar. This produced a very thick gel, similar to the consistency of gelatin, which would not flow through the abrasives hopper 26. In one embodiment, a discharge hose (not shown) was attached to the abrasives hopper 26. The fluid flowed from the abrasives hopper 26 into the slurry tank 27. The slurry tank 27 was lowered and relocated just below the abrasives hopper 26. The effluent hose is about 3 feet (1 meter) in length and only empties down into the slurry tank 27. This change made a huge difference in the suction created by the abrasives hopper 26 and also eliminated the water that would flow up into the abrasives hopper 26. The sand/guar mix now flows freely through the abrasives hopper 26 without problem.

In another embodiment, another improvement made to the system 20 is the introduction of air into the slurry tank 27. When the valve of the abrasives hopper 26 is opened to allow the abrasive and guar to enter the fluid stream, air enters the fluid stream also. Previously, when the desired amount of sand had entered the system 20, the valve on the abrasives hopper 26 was closed to keep fluid from entering the abrasives hopper 26 until more sand was required. Once the fluid issue had been resolved, the valve was allowed to stay open. However, it was noticed that the mixing of the abrasive and water was superior to when the valve was closed. This could be observed by having much less sand settling in the bottom of the slurry tank 27, by observing sand in samples of the slurry that were taken, and by observing much faster cutting times (time to cut through a particular piece of casing). It was also noticed that cutting times improved more than what could be attributed to increased sand concentration. Cutting time of casing was reduced from 30 seconds for a single thickness to less than 10 seconds. The entrained air in the fluid increases the cutting effectiveness considerably. Being able to entrain air into the fluid and then pressurize it is a very unique characteristic for the abrasive fluid injection system 20. Traditional fracturing pump operators typically do everything possible to keep air or other gases out of the influent stream of the pump for fear of the pump cavitating. Cavitation can cause serious damage to the pump. Any gases or foams used in the fluid stream must be injected after the pump. If desired, gases could also be injected or bubbled at low pressure in the slurry tank 27 to be added to the fluid. Therefore, the abrasive injection system 20 of the invention has superior cutting times when compared to the traditional fracturing pump or cement pump.

In other embodiments, the invention is a method for high pressure abrasive fluid injection into an abrasive jet tool in a wellbore. FIG. 6 is a flowchart illustrating an embodiment of the method of the invention for high pressure abrasive fluid injection. FIG. 6 describes the embodiment of the method of the invention associated with the embodiment of the system of the invention illustrated in FIG. 2.

At block 60, low pressure abrasive slurry is mixed by circulating from a slurry tank, through a low pressure abrasive pump, by an abrasive hopper, and back to the slurry tank.

At block 61, the low pressure abrasive slurry is also circulated from the slurry tank, through the low pressure abrasive pump, through a second high pressure valve, through a first high pressure vessel, through a third high pressure valve, and back to the slurry tank.

At block 62, high pressure non-abrasive fluid is sent by a high pressure non-abrasive pump through a first high pressure valve to a first high pressure vessel.

At block 63, the second high pressure valve is opened to allow abrasive slurry to fill the first high pressure vessel.

At block 64, the first, second, and third high pressure valves are opened to allow the high pressure non-abrasive fluid to push the abrasive slurry through the first high pressure vessel to an abrasive jet tool.

At block 65, the first, second, and third high pressure valves are opened to allow more non abrasive fluid to go directly to the abrasive jet tool while the high pressure non-abrasive pump refills the first high pressure vessel through the first high pressure valve. In this manner, the abrasive slurry is injected into the pressurized tubing system, alternating with slugs of non abrasive fluid.

FIG. 7 shows a flowchart illustrating an embodiment of the method of the invention for high pressure abrasive fluid injection. FIG. 7 describes the embodiment of the method of the invention associated with the embodiment of the system of the invention illustrated in FIG. 3.

At block 70, proceed here from block 64 of FIG. 6.

At block 71, the first, second, and third high pressure valves are rotated to allow abrasive slurry to fill a second high pressure vessel through a fourth high pressure valve.

At block 72, the first, second, third, and fourth high pressure valves are rotated to allow the high pressure non-abrasive fluid to push the abrasive slurry through the second high pressure vessel and a fifth high pressure valve to the abrasive jet tool, while the high pressure non-abrasive pump refills the first high pressure vessel through the first and second high pressure valves.

The abrasive fluid injection system and method of the invention has numerous advantages over conventional methods. The invention provides improvements to the high pressure abrasive pumping process that allows for improved performance and more cost effective operation.

Use of the invention provides that a high pressure pump that is specially constructed to handle abrasives, such as a fracturing or cementing pump, would no longer be required for abrasive jet perforating, cutting, or cleaning. Using a high pressure fresh water pump instead, in conjunction with the abrasive injection system of the invention, will greatly reduce costs. This cost reduction would make abrasive jet perforating an economically attractive option for lesser producing wells that cannot justify the added expense of large, high-cost pump rental. In addition, the abrasive injector and freshwater high pressure pump will comprise smaller and lighter pieces of equipment. This allows for a smaller footprint at the well site and will also be useful in remote locations where larger units cannot enter or cannot be obtained.

For industrial cleaning applications, use of the invention would result in improved abrasive cutting performance as the sand is entrained in the fluid and reaches a higher velocity.

It should be understood that the preceding is merely a detailed description of specific embodiments of this invention and that numerous changes, modifications, and alternatives to the disclosed embodiments can be made in accordance with the disclosure here without departing from the scope of the invention. The preceding description, therefore, is not meant to limit the scope of the invention. Rather, the scope of the invention is to be determined only by the appended claims and their equivalents.

We claim:

1. A system for injecting high pressure abrasive fluid into an abrasive jet tool in a wellbore, comprising:

an abrasives hopper;

a slurry tank connected to the abrasives hopper;

a low pressure abrasive pump connected to the slurry tank, wherein the low pressure abrasive pump comprises abrasive-resistant materials;

a first high pressure vessel connected to the low pressure pump through a first high pressure valve;

a slurry circulation line for circulating slurry from the slurry tank through the low pressure abrasive pump past the abrasive hopper and back to the slurry tank;

a high pressure non-abrasive pump connected to the first high pressure vessel through a second high pressure valve, wherein the high pressure non-abrasive pump is configured to pressurize the first high pressure vessel; and an abrasive jet tool connected to the first high pressure vessel through a third high pressure valve.

2. The system of claim 1, further comprising:

a second high pressure vessel connected through a fourth high pressure valve to the low pressure abrasive pump and to the high pressure non-abrasive pump and connected through a fifth high pressure valve to the abrasive jet tool.

3. The system of claim 1, further comprising:

a water supply tank connected to a line connecting the high pressure non-abrasive pump.

4. The apparatus of claim 3, further comprising:

a flow restrictor connected to the high pressure non-abrasive pump and the water supply tank.

5. The apparatus of claim 1, wherein the first high pressure valve comprises a dump valve.

6. The apparatus of claim 1, further comprising:

a pressure pulse damper connected to a line connecting the high pressure non-abrasive pump and the first high pressure valve; and a pressure sensor connected to the pressure pulse damper.

7. The apparatus of claim 1, further comprising:

a fluid discharge hose connecting the abrasives hopper to the slurry tank.

8. A method for injecting high pressure abrasive fluid into an abrasive jet tool in a well bore, comprising:

mixing low pressure abrasive slurry by circulating the abrasive slurry from a slurry tank, through a low pressure abrasive pump, by an abrasive hopper, and back to the slurry tank, wherein the low pressure abrasive pump comprises abrasive-resistant materials;

circulating the low pressure abrasive slurry from the slurry tank, through the low pressure abrasive pump, through a second high pressure valve, through a first high pressure vessel, through a third high pressure valve, and back to the slurry tank;

sending high pressure non-abrasive fluid by a high pressure non-abrasive pump through the first high pressure valve to a first high pressure vessel;

opening the second high pressure valve to allow abrasive slurry to fill the first high pressure vessel; and rotating the first, second, and third high pressure valves to allow the high pressure non-abrasive fluid to push the abrasive slurry through the first high pressure vessel to an abrasive jet tool.

9. The method of claim 8, further comprising:

rotating the first, second, and third high pressure valves to allow more non-abrasive fluid to go directly to the abrasive jet tool while the high pressure non-abrasive pump refills the first high pressure vessel through the first high pressure valve.

10. The method of claim 8, further comprising:

rotating the first, second, and third high pressure valves to allow abrasive slurry to fill a second high pressure vessel through a fourth high pressure valve; and rotating the first, second, third, and fourth high pressure valves to allow the high pressure non-abrasive fluid to push the abrasive slurry through the second high pressure vessel and a fifth high pressure valve to the abrasive jet tool, while the non-abrasive high pressure pump refills the first high pressure vessel through the first and second high pressure valves.

11. The method of claim 8, further comprising:

adding guar powder to the slurry tank to gel the abrasive fluid.

12. The method of claim 8, further comprising:

adding air to the slurry tank to increase effectiveness of the abrasive jet tool.

* * * * *